US005711131A

United States Patent [19]

Thomas

[11] Patent Number: 5,711,131

[45] Date of Patent: Jan. 27, 1998

[54] STRUCTURAL TRUSS

[75] Inventor: Mervyn Harvey Thomas, Worcester, England

[73] Assignee: James Thomas Engineering Limited, Worcestershire, England

[21] Appl. No.: 291,070

[22] Filed: Aug. 16, 1994

[30] Foreign Application Priority Data

Aug. 19, 1993 [GB] United Kingdom ..... 9317280

[51] Int. Cl.[6] ..... E04C 2/38

[52] U.S. Cl. ..... 52/656.9; 52/653.2; 52/655.1; 403/170

[58] Field of Search ..... 52/653.2, 655.1, 52/656.1, 656.9, 668, 681, 690, 637, 645, 650.1, 650.3, 693, 651.1; 403/11, 13, 14, 49, 170, 174, 292, 298, 311, 361, 169, 217

[56] References Cited

U.S. PATENT DOCUMENTS

| | | | |
|---|---|---|---|
| 2,744,590 | 5/1956 | Butts | 52/645 |
| 3,521,421 | 7/1970 | Schroeder | 52/648.1 |
| 3,727,362 | 4/1973 | Ellison et al. | 52/650.1 |

FOREIGN PATENT DOCUMENTS

| | | | |
|---|---|---|---|
| 3344555 | 6/1985 | Germany | 52/656.9 |
| 336183 | 3/1959 | Switzerland | 52/637 |

*Primary Examiner*—Creighton Smith
*Attorney, Agent, or Firm*—Loeb & Loeb LLP

[57] ABSTRACT

A structural truss, eg to provide support in building, exhibition, display lighting, decorative and other structures, comprises an elongate framework at opposite ends of which are connectors of a common forked form spaced limbs of which have registering holes for a retaining pin or bolt and are disposed to be vertically spaced apart in a normal orientation of the truss in use. The arrangement of the connectors relieves the retaining pins or bolts of at least a substantial portion of the load of, and on, the truss when it is in use. In the illustrated embodiment the connectors enable the truss to be inverted from one orientation to another for use, and two of the trusses to be connected together end to end. Securing in different orientations is facilitated by having the limbs of each connector offset relative to an anchorage of the connector to the framework, and having the limbs of a connector at one end of the framework offset in the opposite direction to the limbs of a corresponding connector at the other end of the framework.

20 Claims, 2 Drawing Sheets

STRUCTURAL TRUSS

BACKGROUND OF THE INVENTION

This invention relates to structural trusses such as may be used to provide support in building, exhibition, display lighting, decorative and various other structures.

A structural truss commonly comprises an elongate framework, in which frame members may be arranged generally in a ladder and/or box configuration, having connectors at opposite ends by which the truss can be releasably connected to other trusses, members or parts for use. The connectors have conventionally been in male and female forms, usually comprising a blade element and a fork element, a blade element engaging between the limbs of a fork element and the elements being secured together by means of retaining pins or bolts inserted in registering holes in the elements. Because of the male and female form of the connectors the truss can be used in only one orientation relative to the parts to which it is to be secured for use in order for the connectors to be interconnected. Furthermore connectors have been presented such that in the normal orientation of the truss for use the limbs of the fork element are horizontally spaced apart to receive a blade element and the retaining pins or bolts have to be inserted horizontally through the engaged fork and blade elements to secure them together. The pins or bolts are therefore subjected to the load of, and imposed during use on, the secured truss and consequently can be under appreciable and continuous stress whilst the connectors are interconnected, which may lead to fracture of the pins or bolts.

BRIEF SUMMARY OF THE INVENTION

The present invention seeks to avoid at least some of these shortcomings of known structural trusses.

According to a first aspect the present invention consists in a structural truss comprising an elongate framework having connectors fixed at the opposite ends all of a common forked form having spaced limbs fixedly positioned relative to the framework and extending longitudinally thereof away from the opposite ends which limbs are disposed to be vertically spaced apart in a normal orientation of the truss and have registering holes and retaining means which insert into the holes. Pins and bolts are suitable retaining means.

Having the connectors all of the common forked form can simplify manufacture of the truss. More importantly though, because of the forked form of the connectors, when such connectors are connected together in a normal orientation of the truss for use the retaining means are relieved of, or at least a substantial portion of, the load of the truss and what it may support, when the truss is secured in position for use. The connectors and the parts to which they are connected for securing the truss take the load of the truss directly. A stronger connection between the truss and the parts to which it is secured may be achieved in consequence.

Additionally, when fitting the truss for use it may be rested at the spaced limbs of the connectors on the parts to which it is to be connected before the retaining means are applied, so that the fitting procedure may be facilitated.

The parts to which the truss is to be connected for use may have similar connectors to mesh with the connectors of the truss for the truss to be secured to the parts. Alternatively the parts may have blade elements or portions which insert between the spaced limbs of the truss's connectors for the truss to be secured and have holes to register with those in the spaced limbs to be engaged by the retaining means.

Trusses in accordance with the first aspect of the present invention may be connected together, end to end, by their connectors, the spaced limbs of the engaged connectors intermeshing with one another.

Preferably the connectors of the truss are so disposed that the truss may be secured to a part to which it is connected for use, or to a similar truss in accordance with the invention, in more than one orientation. Thus the connectors may be arranged to enable the truss to be secured at either end to any one part adapted to co-operate with the connectors or to either end of a similar truss, and they may be arranged also to enable the truss to be inverted from one orientation to another to be secured for use. Conveniently the disposition of the connectors is such that in whichever of its possible orientations for use it is applied the truss retains a required alignment, or other assembled relationship, with the part or other similar truss to which it is connected. In a preferred embodiment this is achieved by having the spaced limbs of each connector asymmetrically positioned relative to a central plane of an anchorage of the connector to the respective end of the framework.

The framework will usually be made up of metal frame members but it may be constructed from frame members of other materials, such as timber or plastics. Metal frame members may be of tubular, strip and/or L-section form. The framework may have its frame members arranged in a ladder and/or box structure. In one form the framework has tubular longitudinal frame members and the connectors are fixed to the ends of those longitudinal frame members, the connectors having spigots which are secured in the bores of the frame members and the spaced limbs of the connectors being off-set from the central axis of the spigots for the purpose above-mentioned. Instead of spigots the connectors may have sleeves which fit over and are secured to the ends of the longitudinal frame members.

It will be appreciated from the foregoing that a truss in accordance with the first aspect of the present invention may be more versatile in its application than known trusses, may be readily fitted for use and is able to be fixed with substantial security while in use.

According to a second aspect the present invention consists in a structure comprising at least one structural truss in accordance with the first aspect of the invention and a part to which the truss is connected at one end of the framework by one of the connectors, said part comprising an element which is inserted between the spaced limbs of the connector and has a hole which registers with the holes in the spaced limbs, and the retaining means being engaged in the registering holes of the spaced limbs and part, thereby connecting the truss and the part together.

The element of the part may comprise one limb of a pair of spaced limbs of a connector of similar form to the connectors of the truss. The part may comprise another structural truss.

An embodiment of the present invention will now be described by way of example only with reference to the accompanying drawings, in which:

DETAILED DESCRIPTION OF THE INVENTION

Figure 1:
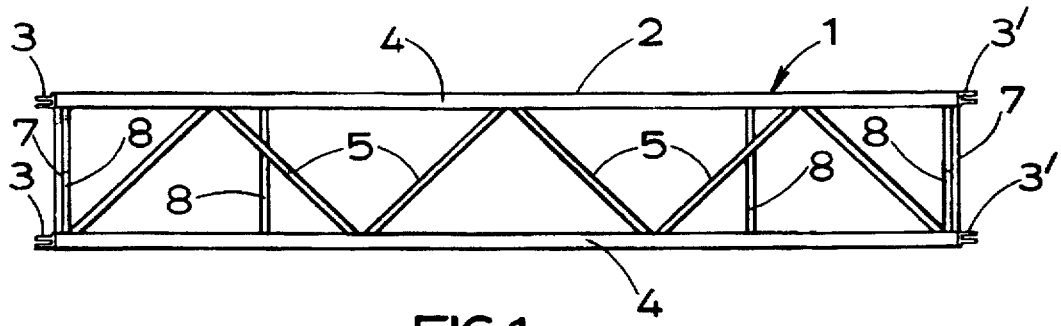
FIGS. 1 and 2 are side and plan views respectively of a structural truss in accordance with the present invention.
Figure 2:
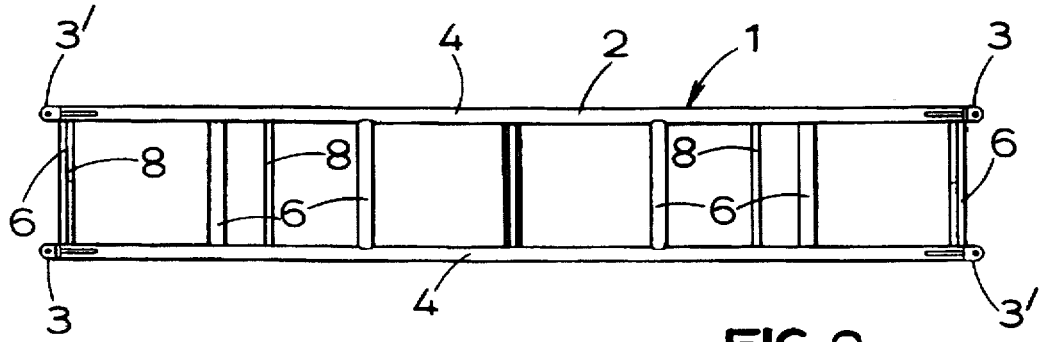
Figure 3:
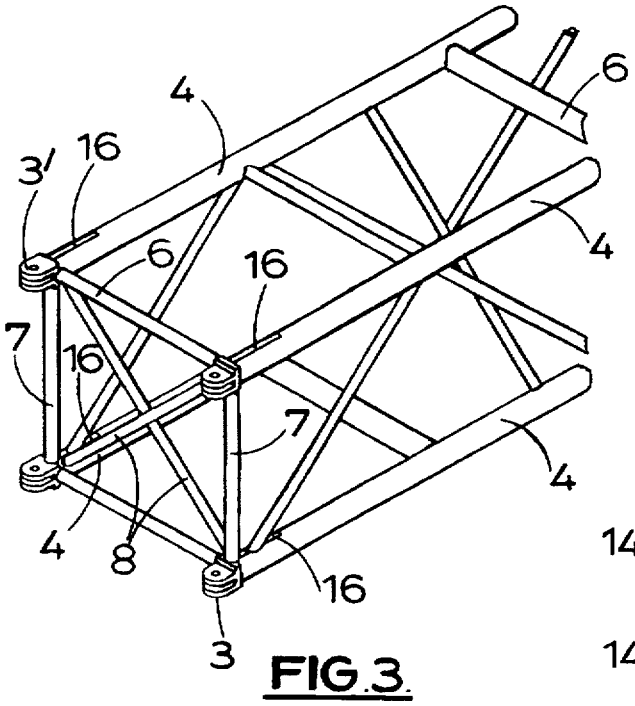
FIG. 3 is a fragmentary perspective view of one end portion of the truss.

Referring to FIGS. 1 to 3 of the drawings, a structural truss 1 is shown which is suitable for a variety of applications, including support for stage or exhibition lighting, use in decorative structures and forming part of display stands. The truss 1 is made entirely of metal, preferably aluminium. It has an elongate framework 2 of square box form in cross-section and at each end four connectors 3,3'.

The framework 2 is constructed from four tubular longitudinal members 4 positioned at the four corners of the square box form, mutually inclined bracing members 5 extending in a zigzag arrangement between, and welded to, the longitudinal members 4 at the two upright sides of the box form, and parallel bracing members 6 extending laterally between, and welded to, the longitudinal members 4 at the ends and at spaced intervals along the top and bottom sides of the box form so that the framework has a ladder-like construction in plan view, as shown in FIG. 2. Adjacent to the parallel bracing members 6 at the ends of the longitudinal members 4 there are vertical bracing members 7 extending between, and welded to, the longitudinal members at the upright sides of the box form. In addition, at spaced intervals along its length there are pairs of crossed tie members 8 which extend diagonally between, and are welded to, the longitudinal members 4 at diagonally opposite corners of the box form. The parallel bracing members 6 and vertical bracing members 7 are also tubular; the inclined bracing members 5 and tie members 8 may be tubular or be made from solid bar.

Figure 4:
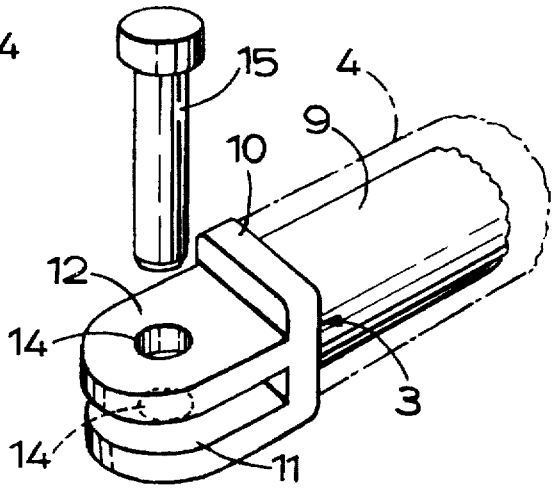
FIG. 4 is an enlarged perspective view of a connector of the truss.

The connectors 3,3' are all of the same forked form. Each connector 3,3' is machined from a solid elongated block of metal of square cross-section. From the block is formed, as shown in FIG. 4, a tubular spigot 9, a square plinth 10 concentrically integral with one end of the spigot 9 and two spaced, parallel, limbs 11,12 integral with and extending perpendicularly from the plinth 10 at the opposite face of the plinth from the spigot. The spaced limbs 11,12 are of similar thicknesses and have rounded free ends remote from the plinth 10. A first one, 11, of the spaced limbs is adjacent one side edge of the plinth 10 and the second limb 12 is at an intermediate part of the plinth disposed to the side of the common central axis of the plinth and spigot 9 remote from the first limb 11. The spaced limbs 11,12 are therefore in an offset relationship to the spigot. Co-axial holes 14 of similar diameter are formed in the two spaced limbs 11,12 to receive a retaining pin or bolt 15.

The connectors 3,3' are fixed to the opposite ends of the longitudinal members 4 of the framework 2. Their spigots 9 are inserted into the ends of the longitudinal members 4, the spigots being of an external diameter to be a close push fit in the bores of the longitudinal members, and the plinths 10 abutting against the end faces of the longitudinal members when the spigots are fully home in the bores of the longitudinal members. Diametrically opposite slots 16, FIG. 3, are pre-cut into the ends of the longitudinal members 4 which extend along the members for the lengths of the spigots. At these slots 16 the longitudinal members 4 are welded to the spigots 9 to secure the connectors to the longitudinal members. A strong joint results between the connectors and longitudinal members. The hollow spigot allows good heat dispersion from the joint during the welding operation. The connectors are secured such that their spaced limbs 11,12 are presented horizontally and the limbs of each connector are vertically spaced apart. As clearly seen in FIGS. 1 to 3, the connectors are also secured so that those, 3, at the longitudinal members along one upright side of the box form of the framework 2 are offset downwardly with respect to their spigots 9, and those 3', at the longitudinal members along the opposite upright side of the box form are offset upwardly with respect to their spigots. The connectors at the opposite ends of the longitudinal members are differently offset.

Instead of being welded to the longitudinal members the connectors may be secured to them at their spigots by means of bolts or pins provided with suitable retainers.

Connectors of the truss can be connected to connectors of a similar truss to secure the trusses together, the spaced limbs 11,12 of one connector being horizontally meshed with those of the mating connector and a retaining pin or bolt 15 being inserted into the registering holes 14 of the intermeshed limbs 11,12 to secure the connection. Because of the arrangement of their connectors the trusses may be readily connected together at either of their ends and either way up, that is to say with top and bottom sides of the box forms of the frameworks the right way up or inverted, and still be in true alignment or in another required relationship. The people assembling the trusses, therefore, generally do not have to concern themselves about the relative orientations of the trusses as long as the spaced limbs 11,12 of the connectors are similarly presented for intermeshing.

Instead of being connected to other trusses for use the truss may be connected to other parts for use. The other parts may, for example, have plates, or plate-like portions, which can be received between the spaced limbs 11,12 of the connectors and have holes to register with the holes 14 to receive the retaining pins or bolts 15. Another possibility is that the parts have fixed or attachable to them connectors similar to, or compatible with the, connectors 3,3' of the truss at which the connections between the truss and parts can be made.

Some examples of various ways in which the truss may be applied for use are illustrated in FIGS. 5 to 8 of the accompanying drawings and will now be briefly described.

Figure 5:
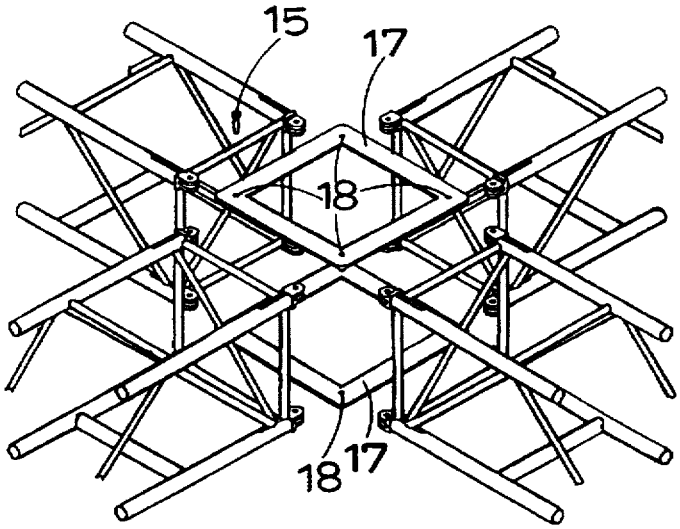
FIGS. 5 to 8 show various ways in which the truss may be put to use.

In FIG. 5, which is an exploded perspective view, four trusses of the form described above are connected in a right-angled cross configuration at the same level to the four sides of two square support plates 17. The spaced limbs of the connectors of adjacent longitudinal members 4 in the frameworks of adjacent trusses intermesh and the retaining pins or bolts 15 which secure them together also engage in registering holes 18 at the corners of the support plates 17.

Figure 6:
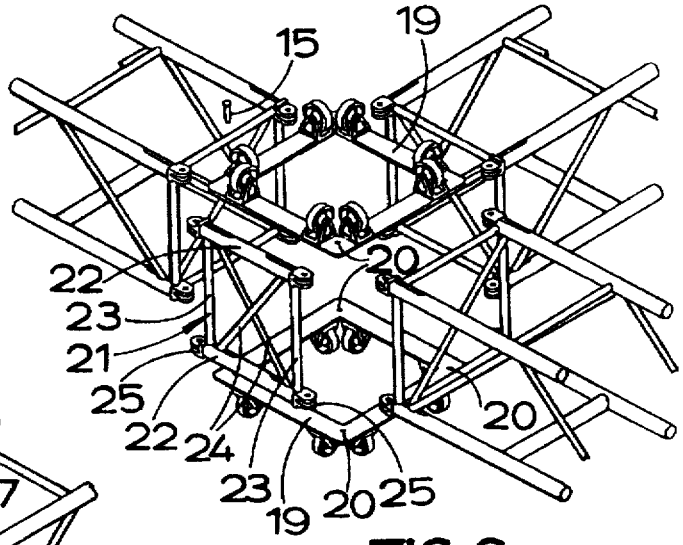

FIG. 6, also an exploded perspective view, shows three trusses of the form described connected together at right angles to one another at the same level to three sides of two square tower sleeve plates 19. Again the spaced limbs of the connectors of adjacent longitudinal members in the framework of adjacent trusses intermesh and the retaining pins or bolts 15 which secure them together also engage in registering holes 20 at the corners of the tower sleeve plates 19. In addition at the fourth sides of the tower sleeve plates 19 a gate 21 is secured. The gate 21 is a rectangular framework of horizontal, 22, vertical, 23, and crossed diagonal tie, 24, members having connectors 25 fixed to the ends of the horizontal members 22 which are of similar form to, and disposed similarly to, the connectors 3,3' of the trusses. The connectors 25 of the gate 21 intermesh with adjacent connectors of the adjacent trusses and are secured to those connectors and to the tower sleeve plates 19 by the retaining pins or bolts 15 of the truss connectors.

Any number of trusses up to four may be secured to the support plates 17 in the arrangement of FIG. 5 and to the tower sleeve plates 19 in the arrangement of FIG. 6. In the latter arrangement it will be appreciated that a gate as described may be secured at each side of the tower sleeve plates 19 at which trusses are not connected.

Figure 7:
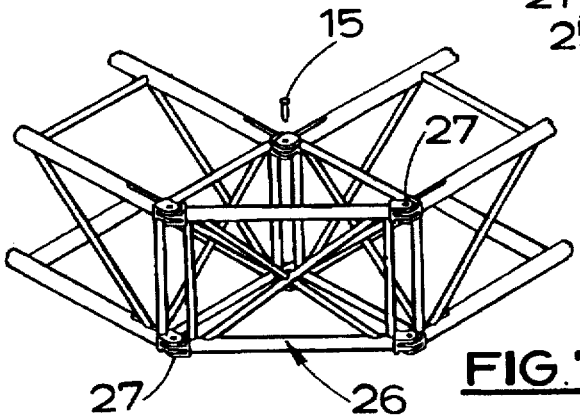
Figure 8:
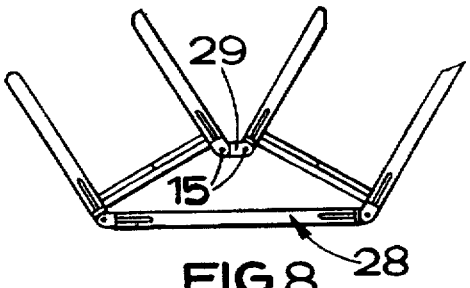
Figure 9:
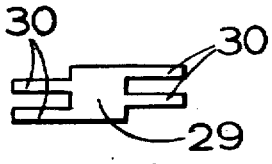
FIGS. 9 and 10 show two forms of connecting fork which may be used with the truss.

FIGS. 7 and 8 each show two trusses connected together at an angle to one another. The trusses in the arrangement of FIG. 7 are connected together at 90°. Inside the angle the connectors at the ends of adjacent, inner, longitudinal members of the trusses are connected together. At the outside of the angle a gate 26, of similar construction to that of the arrangement of FIG. 6 but longer, is secured between the trusses by interconnection of its connectors 27 and the connectors of the outer longitudinal members of the trusses. In the arrangement of FIG. 8, which is a plan view, the trusses are connected together at 60°. As in the arrangement of FIG. 7 a gate. 28, still longer, is similarly secured between the trusses at the outside of the angle. Inside the angle the connectors of the inner longitudinal members of the trusses are not connected together directly but through double-ended connecting forks 29. As shown in FIG. 9, these connecting forks 29 each have pairs of offset spaced limbs 30 at opposite ends, similar to the spaced limbs of the connectors, which intermesh with the spaced limbs of the connectors of the inside longitudinal members and are secured to them by the retaining pins or bolts 15 of those connectors.

Figure 10:
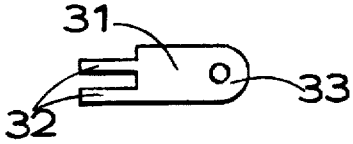

The arrangements shown in FIGS. 5 to 8 have the trusses connected so that the top and bottom sides of the box forms of their frameworks lie in respective common planes. It is possible for trusses to be connected with those sides in different planes. For example the top and bottom sides of the framework of one truss may be horizontal and a second truss may be turned over through 90° about its longitudinal axis such that the corresponding sides of the framework of the secured truss are vertically presented. Since the connectors of adjacent ends of the trusses to be connected then have their respective spaced limbs in planes at 90° to one another they cannot be intermeshed. This is dealt with by using angle connecting forks 31 of the form shown in FIG. 10. Like the connecting forks 29 of FIG. 9, each angle connecting fork 31 is double-ended having pairs of spaced limbs 32,33 at opposite ends similar to the spaced limbs of the connectors but the pair of spaced limbs 33 at one end is turned through 90° from the pair of spaced limbs 32 at the other end. The pairs of spaced limbs 32,33 of the angle connecting forks 31 are able to mesh with the spaced limbs of the connectors of the trusses and the connectors are secured by the retaining pins or bolts of the connectors.

I claim:

1. A structural truss comprising an elongate framework having opposite ends, connectors fixed at said opposite ends each of a forked form having two spaced parallel limbs fixedly positioned relative to said framework and extending longitudinally thereof away from said opposite ends, which said limbs are disposed to be vertically spaced apart in a normal orientation of the truss for use and have registering holes, and retaining means which insert into said holes, wherein each said connector has an anchorage by which it is retained to a respective one of said opposite ends of said framework and has a central plane, and spaced limbs which provide said forked form of said connector and are asymmetrically positioned relative to said central plane.

2. A structural truss according to claim 1 wherein said connectors are disposed and adapted to enable the truss to be connected to other means for use in more than one orientation.

3. A structural truss according to claim 2 wherein said connectors are disposed and adapted to enable the truss to be inverted from one orientation to another to be secured for use.

4. A structural truss according to claim 1 wherein said connectors are disposed at said opposite ends of said framework in positions which enable the truss to be secured at either of said opposite ends to either of said opposite ends of a similar truss.

5. A structural truss according to claim 1 wherein there are two said connectors at said opposite ends of said framework of which said central plane of their said anchorages is a common plane, and the asymmetry of said spaced limbs of said connectors relative to said common plane is comparable but in an opposite sense, said connector at one of said opposite ends of said framework being able to be secured to said connector at the other one of said opposite ends of said framework of a similar truss so that said structural truss and the similar truss are at a common level in a normal orientation of the trusses for use.

6. A structural truss according to claim 1 wherein said framework has tubular longitudinal frame members having opposite ends and said connectors are fixed to said opposite ends of said longitudinal frame members.

7. A structural truss according to claim 6 wherein each said connector is formed in one piece comprising a square plinth having first and second opposed parallel faces transversely of said longitudinal frame members, a spigot having a central plane and extending concentrically from said first face, and said spaced limbs which extend perpendicularly from said second face and are asymmetrically disposed relative and parallel to said central plane of said spigot.

8. A structural truss according to claim 6 wherein said connectors have sleeves which fit over and are secured to said opposite ends of said longitudinal frame members.

9. A structural truss according to claim 1 wherein said framework has a longitudinally extending base structure having corners at said opposite ends of said framework and said connectors are secured to said corners.

10. A structure comprising a structural truss as claimed in claim 1 and a part to which said truss is connected at one of said opposite ends of said framework by one of said connectors, said part comprising an element which is inserted between said spaced limbs of said connector and has a hole which registers with said registering holes of said spaced limbs, and said retaining means engaging in said registering holes of said connector and said hole of said element to connect said truss and said part together.

11. A structure according to claim 10 wherein said part has a further connector of similar form to said connectors of said truss having a pair of fixed positioned spaced limbs in which are registering holes, and said element is one of said spaced limbs of said further connector.

12. A structure according to claim 10 wherein said part is another structural truss.

13. A structure according to claim 10 wherein said part comprises a square plate having corners and said element is one of said corners of said plate.

14. A structure according to claim 11 wherein said part comprises a gate having a rectangular framework having sides and said further connector of said part is at one of said sides.

15. A structure according to claim 10 wherein said part comprises a double-ended connecting fork having two pairs of fixedly positioned spaced parallel limbs extending in opposite directions, said pairs of limbs being in fixed positions relative to one another, said limbs of each said pair having registering holes and said limbs of either pair being able to be meshed with said spaced limbs of one of said connectors of said truss and secured thereto by said retaining means engaged in said registering holes of said connector and said meshing pair of said limbs of said connecting fork.

16. A structural truss comprising an elongate framework having opposite ends, connectors at opposite ends each of a forked form having two spaced limbs which are disposed to be vertically spaced apart in a normal orientation of the truss for use and in which are registering holes, and retaining means which insert into said holes, wherein: said framework has tubular longitudinal frame members having opposite ends and said connectors are fixed to said opposite ends of said longitudinal frame members; and each said connector is formed in one piece comprising a square plinth having first and second opposed parallel faces transversely of said longitudinal frame members, a spigot having a central plane and extending concentrically from said first face, and said spaced limbs which extend perpendicularly from said second face and are asymmetrically disposed relative and parallel to said central plane of said spigot.

17. A structural truss comprising an elongate framework having opposite ends, connectors fixed at said opposite ends each of a forked form having two spaced parallel limbs fixedly positioned relative to said framework and extending longitudinally thereof away from said opposite ends, which said limbs are disposed to be vertically spaced apart in a normal orientation of the truss for use and have registering holes, and retaining means which insert into said holes, wherein said framework has tubular longitudinal frame members having opposite ends and said connectors are fixed to said opposite ends of said longitudinal frame members, and said connectors have sleeves which fit over and are secured to said opposite ends of said longitudinal frame members.

18. A structure comprising:

a structural truss comprising an elongate framework having opposite ends, connectors fixed at said opposite ends each of a forked form having two spaced limbs fixedly positioned relative to said framework and extending longitudinally thereof away from said opposite ends, which said limbs are disposed to be vertically spaced apart in a normal orientation of the truss for use and have registering holes, and retaining means which insert into said holes; and a part to which said truss is connected at one of said opposite ends of said framework by one of said connectors, said part comprising an element which is inserted between said spaced limbs of said connector and has a hole which registers with said registering holes of said spaced limbs, and said retaining means engaging in said registering holes of said connector and said hole of said element to connect said truss and said part together, wherein said part comprises a double-ended connecting fork having two pairs of fixedly positioned spaced limbs extending in opposite directions, said pairs of limbs being in fixed positions relative to one another, said limbs of each said pair having registering holes and said limbs of either pair being able to be meshed with said spaced limbs of one of said connectors of said truss and secured thereto by said retaining means engaged in said registering holes of said connector and said meshing pair of said limbs of said connecting fork.

19. A structure according to claim 18 wherin said limbs of said two pairs of spaced limbs are all parallel and said one pair is offset with respect to said other pair.

20. A structure according to claim 18 wherein said limbs of said one pair of spaced limbs are spaced apart in one direction and said spaced limbs of said other pair are spaced apart in a direction at 90° to said one direction.

* * * * *